US006688085B2

(12) United States Patent
Yu Chen

(10) Patent No.: US 6,688,085 B2
(45) Date of Patent: Feb. 10, 2004

(54) PACKAGING MACHINE

(76) Inventor: Hsiu-Man Yu Chen, No. 27, Sec. 1, Dafu Rd., Tantz Shiang, Taichung 427 (TW)

( * ) Notice: Subject to any disclaimer, the term of this patent is extended or adjusted under 35 U.S.C. 154(b) by 0 days.

(21) Appl. No.: 10/076,307

(22) Filed: Feb. 19, 2002

(65) Prior Publication Data

US 2003/0154698 A1 Aug. 21, 2003

(51) Int. Cl.[7] ..... B65B 13/30

(52) U.S. Cl. ..... 53/592; 53/582; 100/29; 100/32; 156/579

(58) Field of Search ..... 53/582, 592; 100/32, 100/33 R, 33 PB, 34, 292, 234, 243; 156/579

(56) References Cited

U.S. PATENT DOCUMENTS 3,944,460 A * 3/1976 Karr ..... 156/494
4,717,063 A * 1/1988 Ebihara ..... 227/155
4,795,073 A * 1/1989 Yamamoto et al. ..... 227/120
4,878,608 A * 11/1989 Mitsuhashi ..... 227/120
5,116,453 A * 5/1992 Niedrig ..... 156/580
5,690,268 A * 11/1997 Evans et al. ..... 227/156
6,085,498 A * 7/2000 Hua ..... 53/592
6,412,257 B1 * 7/2002 Liu et al. ..... 53/592

* cited by examiner

*Primary Examiner*—Rinaldi I. Rada
*Assistant Examiner*—Thanh Truong
(74) *Attorney, Agent, or Firm*—Troxell Law Office PLLC

(57) ABSTRACT

A packaging machine includes a machine body having two side plates fixed in parallel on one side of its bottom base. The side plates are bored with a plurality of through holes preset in number at the locations where a cutting device, a clamping device and a band-pressing device are assembled. Each through hole is fitted with a padding sleeve which is wrapped inside the machine body and formed in shape together when the machine body is made integral by means of plastic injection molding, possible to be mass-produced, needless to be additionally drilled with holes for other components, lightening its whole weight and economizing producing cost.

4 Claims, 6 Drawing Sheets

PACKAGING MACHINE

BACKGROUND OF THE INVENTION

This invention relates to a packaging machine, particularly to one made integral of plastic by means of injection molding and having its padding sleeves wrapped inside a machine body and shaped together, possible to be mass-produced, lessening producing cost and lightening its whole weight.

A conventional packaging machine, as shown in FIG. 1, includes a machine body made of metallic material with a casting or a forging mode. The machine body 1 is provided with a bottom base 2 having two protruding-up side plates 3 fixed in parallel at one side. The side plates 3 are bored with a plurality of through holes 7 preset in number to conform to the locations where a cutting device 4, a clamping device 5 and a band pressing device 6 are assembled.

The through holes 7 are drilled after the machine body is cast or forged. As the machine body 1 is cast or forged of metallic material at first and then a plurality of through holes have to be additionally drilled, the result is a comparatively heavy weight and complicated processes of the whole machine body 1.

SUMMARY OF THE INVENTION

The objective of the invention is to offer a packaging machine made integral of plastic by means of injection molding and having its padding sleeves synchronously wrapped inside the machine body and shaped together, possible to be mass-produced, needless to additionally drill holes for other components, economizing producing cost and lightening its whole weight.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
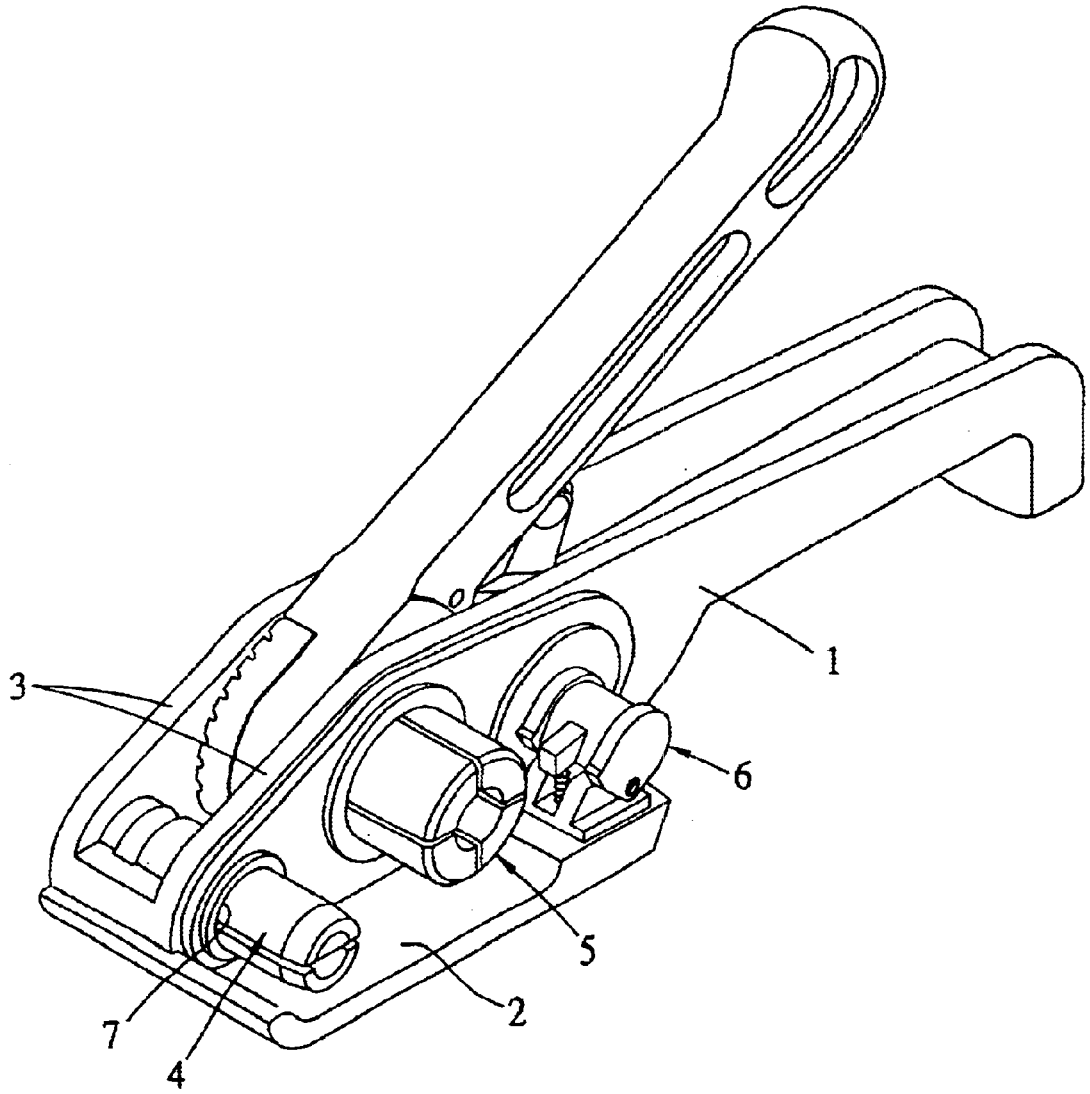
FIG. 1 PRIOR ART
FIG. 1 is a perspective view of a conventional packaging machine.
Figure 2:
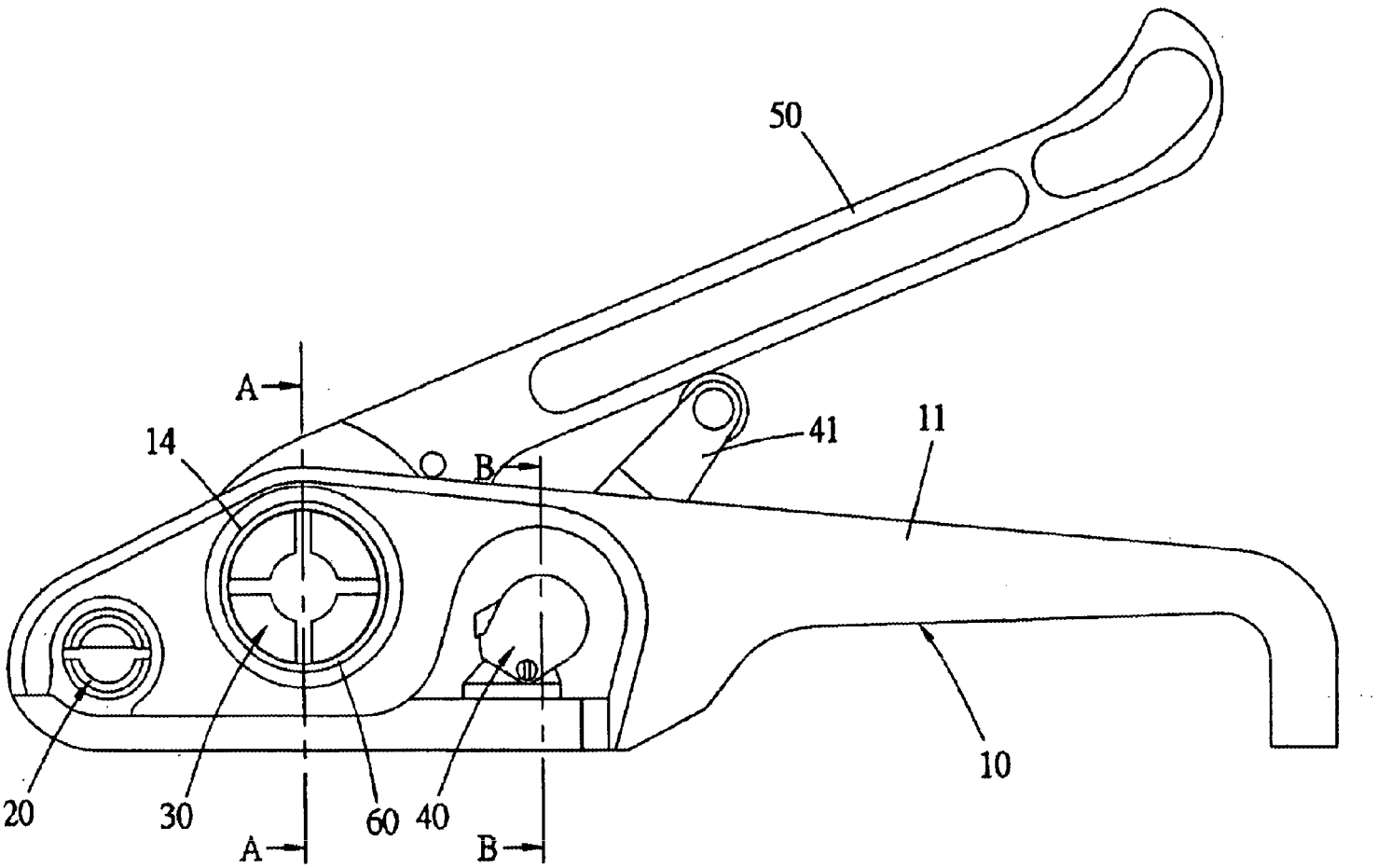
FIG. 2 is a cross-sectional view of a packaging machine in the present invention.
Figure 3:
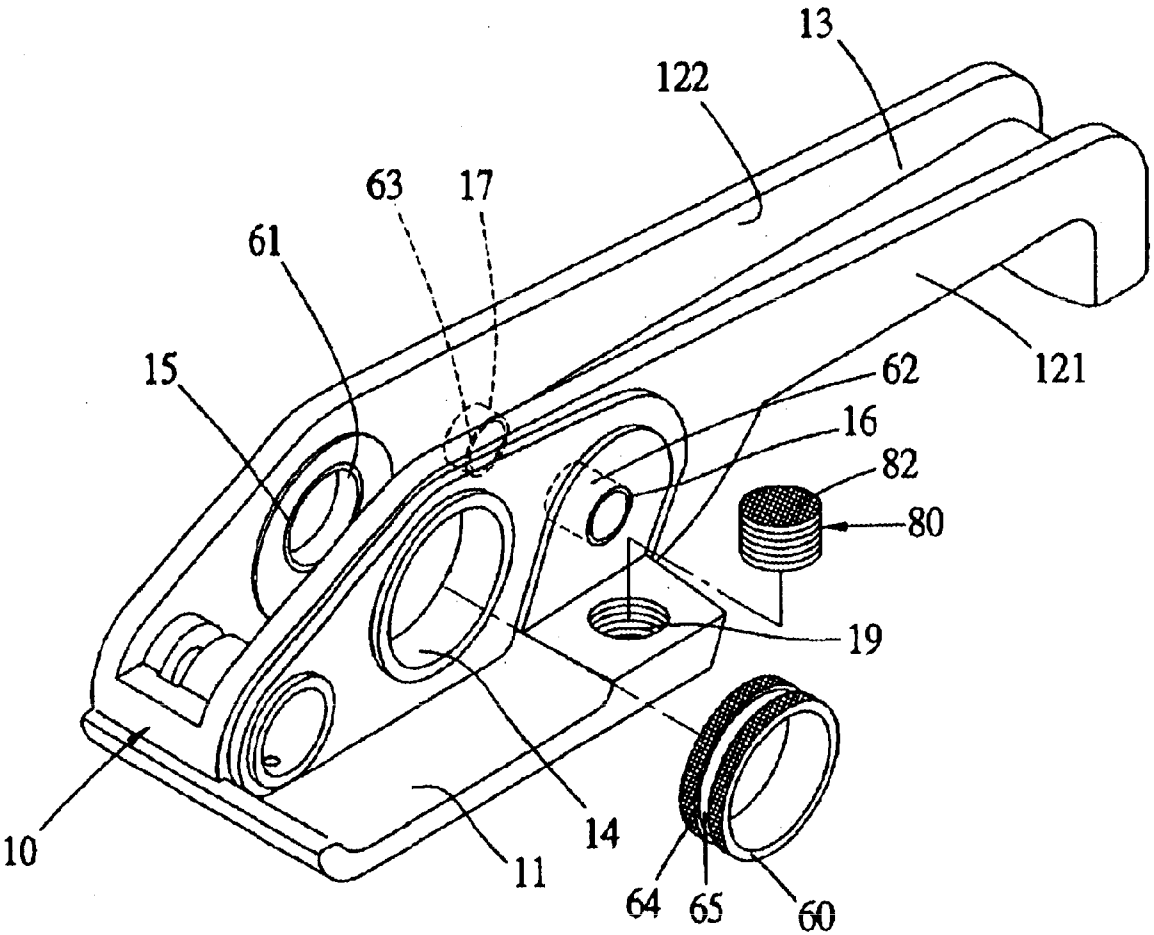
FIG. 3 is an exploded perspective view of the packaging machine in the present invention.

A preferred embodiment of a packaging machine in the present invention, as shown in FIGS. 2 and 3, includes a machine body 10, a cutting device 20, a clamping device 30, a band pressing device 40 and an operating lever 50 as main components combined together.

Figure 4:
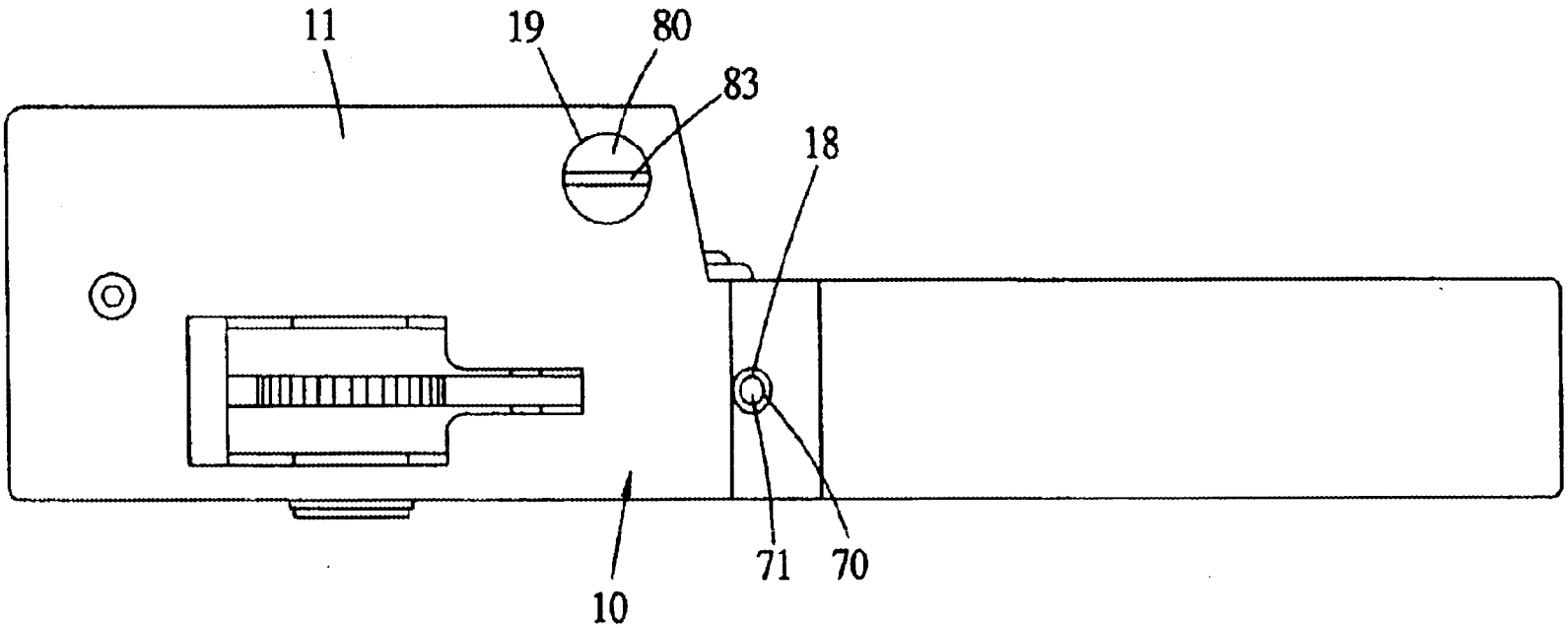
FIG. 4 is a bottom view of the packaging machine in the present invention.

The machine body 10 is fixed with a bottom base 11 having two protruding-up side plates 121, 122 provided in parallel at one side. A space 13 is formed between two side plates 121, 122 for receiving an operating lever 50 and a transmitting block 41 respectively to activate the clamping device 30 and the band-pressing device 40 to move therein. Then, the side plates 121, 122 are bored with a first and a second through holes 14 and 15 to conform to the location of the clamping device 30, and a third and a fourth through holes 16 and 17 to match with the position of the band-pressing device 40. Besides, a round hole 18 corresponding to the position of the transmitting block 41 is provided in the containing space 13 of the bottom base 11, as shown in FIG. 4.

The machine body 10 is made integral of plastic by means of injection molding and has its bottom base 11 provided with a threaded hole 19 conforming to one side of the band-pressing device 40.

In addition, a plurality of padding sleeves 60, 61, 62, and 63 preset in number and made of metallic material of predetermined strength are respectively fitted in the first, the second, the third and the fourth through holes 14, 15, 16, and 17. When the machine body 10 is formed integral with plastic injection molding, these padding sleeves 61, 62, 63 and 64 are synchronously wrapped inside the machine body 10 and shaped together. Each padding sleeve 60, 61, 62 or 63 is formed with a flange 64 respectively around opposite circumferential surfaces, the flange 64 has a pressed pattern in the surface, and an annular groove 65 is formed between two parallel flanges 64. By so designing, the flanges 64 and their pattern can greatly stabilize the combination of metal with plastic to prevent the padding sleeves 60, 61, 62 and 63 from rotating, and guard them from shifting or falling off, because the plastic of the machine body 1 is fixedly stuck inside the annular grooves 65.

Further, a threaded connecter 70 is fixedly fitted in a round hole 18 at a lower side of the machine body 10, and the transmitting block 41 is stably fastened in the threaded connecter 70 by means of a fixing bolt 71. When the machine body 10 is integrally injection-molded, the threaded connecter 70 is synchronously wrapped in it and shaped together.

Then, a prop member 80 is shaped a round block and formed with threads around its outer circumferential surface to be threadably fitted in the threaded hole 19 of the machine body 10. The prop member 80 is further formed with projecting teeth 82 all over on the top surface to tightly hold the packaging band, and a diametrical groove 83 formed in the bottom for a flat screwdriver or the like to be inserted and turned around therein so as to move the prop member 80 up or down. Thus, the prop member 80 can be adjusted to a most proper height for tightly holding the packaging band, and should its top projecting teeth 82 be worn off, the prop member 80 can be moved upward and equally function to hold the packaging band tightly.

Next, the combination and the functions of the components in the invention are specifically described below.

Figure 5:
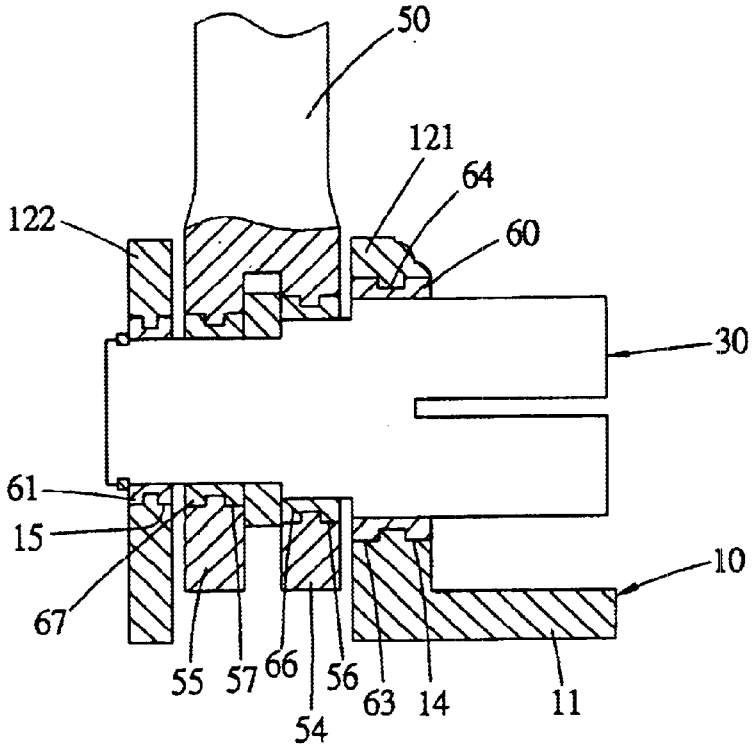
FIG. 5 is a cross-sectional view of the line A—A in FIG. 2.
Figure 6:
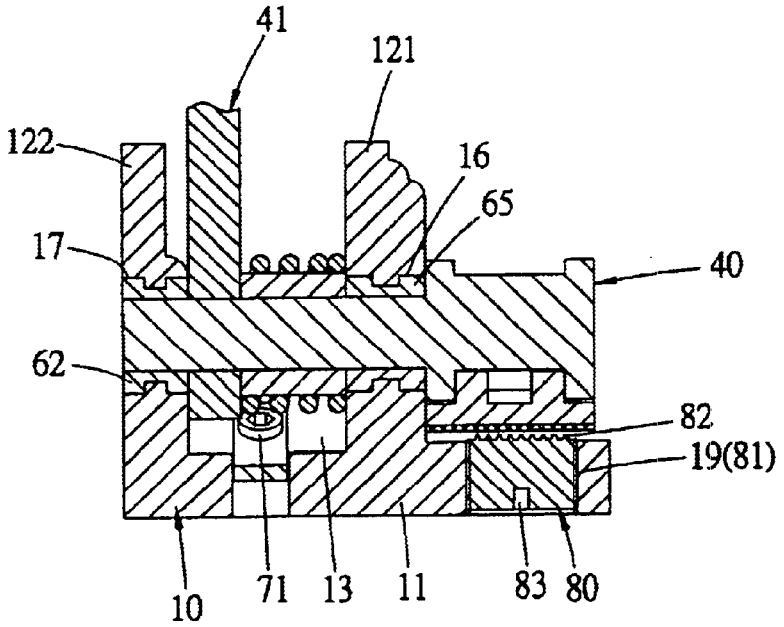
FIG. 6 is a cross-sectional view of the line B—B in FIG. 2.
Figure 7:
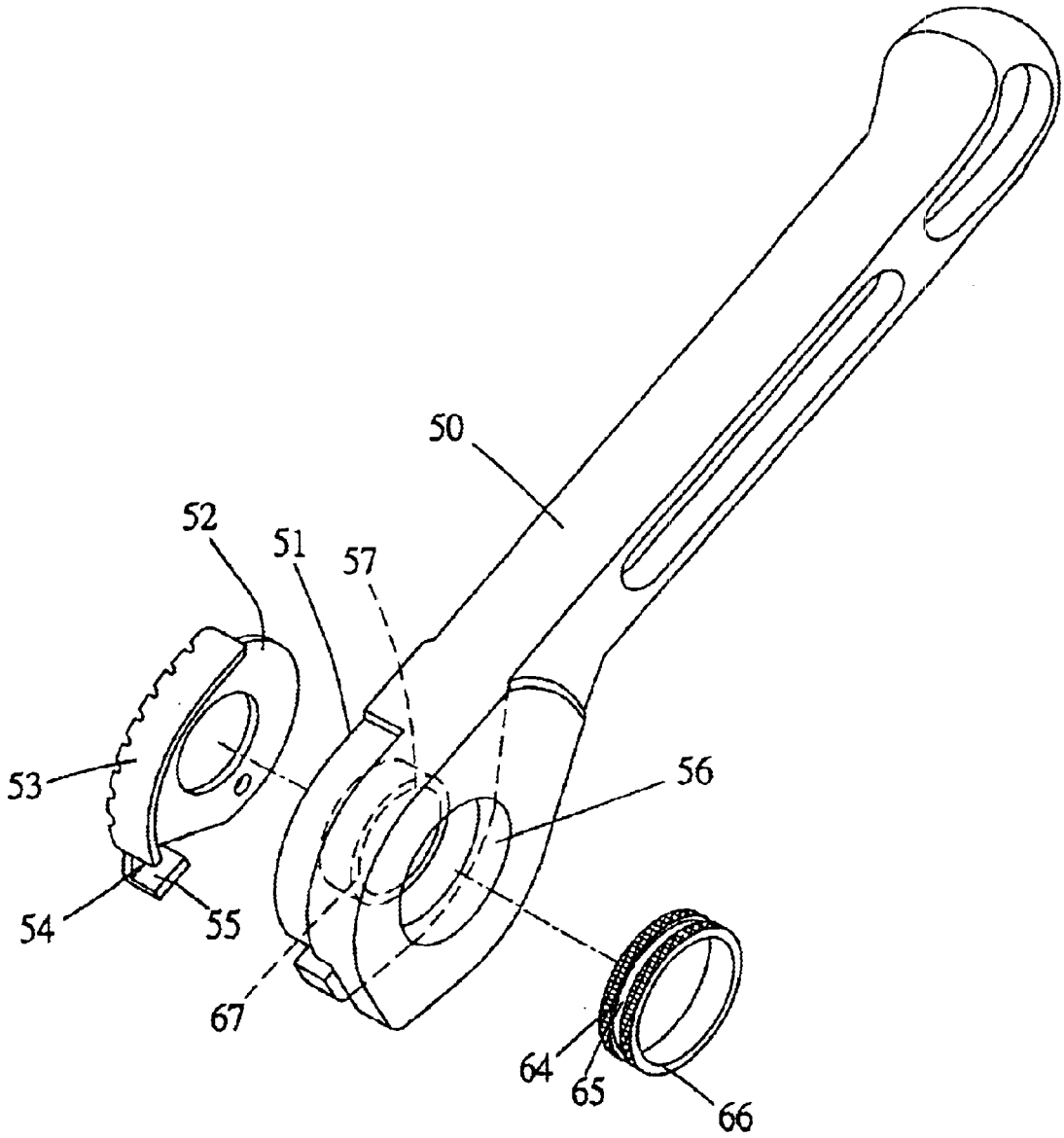
FIG. 7 is an exploded perspective view of the operating rod of the packaging machine in the present invention.

The padding sleeves 60, 61, 62 and 63 are respectively deposited in the first, the second, the third and the fourth through holes 14, 15, 16 and 17 of the machine body 10 placed in a mold, and the threaded connecter 70 is fitted in the round hole 18 of the machine body 10, as shown in FIGS. 4, 5 and 6. When the machine body 10 is made integral by means of plastic injection molding, these padding sleeves 60, 61, 62, 63 and the threaded connecter 70 are wrapped in it and formed in shape together, thus, lightening its whole weight, and needless to be additionally drilled with holes and economizing producing cost. Then, the cutting device 20, the clamping device 30 and the band-pressing device 40 are orderly assembled with the machine body 10.

Each padding sleeve 60, 61, 62 or 63 is formed with the protruding flange 64 around opposite circumferential surfaces, and each flange 64 has the pressed pattern in the surface, and an annular groove 65 is provided between two parallel flanges 64. Thus, these padding sleeves 60, 61, 62 and 63 become immovable not to rotate, shift or fall off after they are wrapped by the plastic of the machine body 1 and shaped together.

The prop member 80 is capable to be adjusted in height and threadably fitted in the threaded hole 19 of the bottom base 11. Further, the prop member 80 is formed with the projecting teeth on the top surface for tightly holding the packaging band, and the diametrical groove 83 in the bottom for a flat screwdriver or the like to be inserted and turned around therein to move up the prop member 80 to a proper position for tightly holding the packaging band when the toothed top surface of the prop member 80 is worn off.

Furthermore, the operating lever 50 is formed with an arcuate recess 51 on one side of its head portion for receiving a control member 52. The control member 52 is made integral of metal and thermally treated subsequently to increase its strength. The control member 52 has an arcuate return projection 53 diametrically provided along its front portion to engage with the arcuate recess 51 when the control member 52 is fitted on the operating lever 50. The control member 52 further has a notch groove 54 and a diametrical cutting projection 55 orderly provided on the bottom for reinforcement.

The operating lever 50 is also formed integral by means of plastic injection molding, having its opposite side plates respectively bored with a fifth and a sixth through holes 56 and 57 for respectively receiving padding sleeves 66 and 67 made of metallic material of preset strength. When the control lever 50 is injection molded with plastic, the padding sleeves 66, 67 are synchronously wrapped inside the control lever 50 and formed in shape together. Additionally, each padding sleeve 66 or 67 has a flange 64 respectively formed on opposite circumferential surfaces, each flange 64 has a compressed pattern in the surface, and an annular groove 65 is formed between the two parallel flanges 64. The flanges 64 and the pressed pattern on their surfaces can reinforce the stabilized combination of metal with plastic to prevent the padding sleeves 66, 67 from moving around, and the annular groove 65 stuck by plastic can guard the padding sleeves 66, 67 from shifting or falling off.

While the preferred embodiment has been described above, it will be recognized and understood that various modifications may be made therein and the appended claims are intended to cover all such modifications that may fall within the spirit and scope of the invention.

I claim:

1. A packaging machine comprising:

a) a machine body having:
   i) a bottom base;
   ii) two parallel and spaced apart side plates protruding upward from the bottom base; and
   iii) at least two pairs of through holes in the two side plates, each of the at least two pairs of through holes has a metallic padding sleeve integrally formed therein, each metallic padding sleeve having an annular groove formed between two flanges, such that the metallic padding sleeves are integrally formed with the machine body during plastic injection molding;

b) a cutting device connected to the two side plates of the machine body;

c) a clamping device connected to padding sleeves in a first pair of through holes in the two side plates of the machine body;

d) a band pressing device connected to padding sleeves in a second pair of through holes in the two side plates of the machine body; and e) an operating lever pivotally connected between the two side plates of the machine body, such that the operating lever activates the clamping device.

2. The packaging machine according to claim 1, further comprising a prop member having projecting teeth on a top and an elongated groove on a bottom thereof, the prop member being threadedly connected to a threaded hole in the bottom base.

3. The packaging machine according to claim 1, further comprising a control member having a notch groove and a diametrical cutting projection on a bottom thereof, the control member being integrally formed with the operating lever and positioned in an arcuate recess on a first side of a head portion of the operating lever.

4. The packaging machine according to claim 1, wherein the operating lever has two through holes, each of the two through holes has a metallic padding sleeve integrally formed therein, each metallic padding sleeve having an annular groove formed between two flanges, such that the metallic padding sleeves are integrally formed with the operating lever during plastic injection molding.

* * * * *